US007681697B2

(12) United States Patent
Iwata et al.

(10) Patent No.: US 7,681,697 B2
(45) Date of Patent: Mar. 23, 2010

(54) ELEVATOR OPERATION CONTROL DEVICE WHICH CONTROLS THE ELEVATOR BASED ON A SENSED TEMPERATURE

(75) Inventors: Masafumi Iwata, Chiyoda-ku (JP); Takaharu Ueda, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 431 days.

(21) Appl. No.: 11/661,669

(22) PCT Filed: Aug. 25, 2005

(86) PCT No.: PCT/JP2005/015430

§ 371 (c)(1),
(2), (4) Date: Mar. 2, 2007

(87) PCT Pub. No.: WO2007/023546

PCT Pub. Date: Mar. 1, 2007

(65) Prior Publication Data

US 2007/0295563 A1 Dec. 27, 2007

(51) Int. Cl.
*B66B 1/34* (2006.01)

(52) U.S. Cl. ..... 187/393

(58) Field of Classification Search ..... 187/391–396
See application file for complete search history.

(56) References Cited

U.S. PATENT DOCUMENTS 4,629,034 A * 12/1986 Inaba et al. ..... 187/293
4,629,035 A * 12/1986 Tanahashi et al. ..... 187/296
4,898,263 A * 2/1990 Manske et al. ..... 187/247
6,392,537 B1 * 5/2002 Tazumi et al. ..... 340/507
7,527,127 B2 * 5/2009 Osterman et al. ..... 187/391

FOREIGN PATENT DOCUMENTS

| | | |
|---|---|---|
| JP | 9 110329 | 4/1997 |
| JP | 3029883 | 2/2000 |
| JP | 2002 3091 | 1/2002 |
| JP | 3350439 | 9/2002 |
| JP | 2002 302359 | 10/2002 |
| WO | 03050028 | 6/2003 |
| WO | 2005030627 | 4/2005 |
| WO | 2005121002 | 12/2005 |

* cited by examiner

*Primary Examiner*—Jonathan Salata
(74) *Attorney, Agent, or Firm*—Oblon, Spivak, McClelland, Maier & Neustadt, L.L.P.

(57) ABSTRACT

An elevator operation control device has a component temperature detecting portion for detecting a temperature of a drive device, and a component-protective operation control portion for restraining an elevator from operating in accordance with the temperature detected by the component temperature detecting portion. Upon detecting a rise in the temperature of the drive device, the component-protective operation control portion changes operation control parameters of the elevator to restrain the elevator from operating and thus stops the rise in the temperature of the drive device before a protection circuit stops the elevator from operating.

15 Claims, 5 Drawing Sheets

ELEVATOR OPERATION CONTROL DEVICE WHICH CONTROLS THE ELEVATOR BASED ON A SENSED TEMPERATURE

TECHNICAL FIELD

The present invention relates to an elevator operation control device for controlling raising/lowering of a car of an elevator.

BACKGROUND ART

In a conventional elevator control device, a rise in junction temperature resulting from a loss in a semiconductor power element within an inverter device is estimated, and an alternating-current motor for driving a car is stopped when an estimated temperature of the semiconductor power element has exceeded a permissible temperature thereof. Further, an acceleration or a deceleration set in a speed control device is reduced to suppress the rise in junction temperature resulting from the loss when it is detected that the junction temperature has exceeded a maximum warrantable temperature (e.g., see Patent Document 1).

Patent Document 1: Japanese Patent No. 3350439

DISCLOSURE OF THE INVENTION

Problem to be Solved by the Invention

In the conventional elevator control device configured as described above, the alternating-current motor is stopped due to a rise in junction temperature. Therefore, the operation efficiency of an elevator declines.

The present invention has been made to solve the above-mentioned problem, and it is therefore an object of the present invention to obtain an elevator operation control device capable of restraining an elevator from being stopped from operating due to rises in temperatures of components and preventing the operation efficiency of the elevator from declining.

Means for Solving the Problem

An elevator operation control device according to the present invention includes: a component temperature detecting portion for detecting a temperature of a drive device; and a component-protective operation control portion for restraining an elevator from operating in accordance with the temperature detected by the component temperature detecting portion.

DESCRIPTION OF THE PREFERRED EMBODIMENTS

Preferred embodiments of the present invention will be described hereinafter with reference to the drawings.

Embodiment 1

Figure 1:
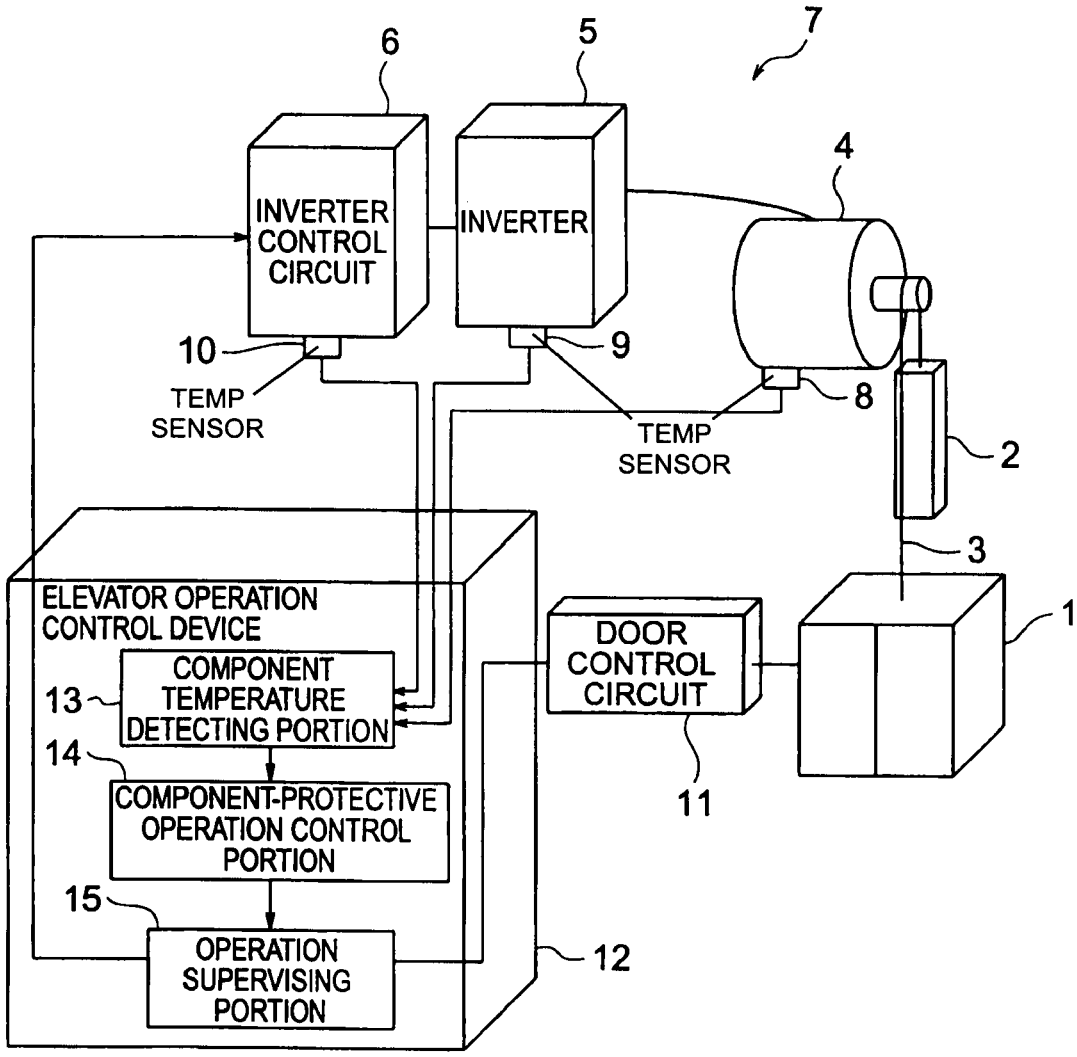
FIG. 1 is a schematic diagram showing an elevator apparatus according to Embodiment 1 of the present invention.

FIG. 1 is a schematic diagram showing an elevator apparatus according to Embodiment 1 of the present invention. Referring to the figure, a car land a counterweight 2, which are suspended within a hoistway by means of a main rope 3, are raised/lowered within the hoistway due to a driving force of a hoisting machine 4. The hoisting machine 4 has a drive sheave around which the main rope 3 is looped, a motor for rotating the drive sheave, and a brake for braking rotation of the drive sheave.

A current supplied to the hoisting machine 4 is controlled by an inverter 5. The inverter 5 is controlled by an inverter control circuit 6. A drive device 7 is composed of the main rope 3, the hoisting machine 4, the inverter 5, and the inverter control circuit 6.

The hoisting machine 4 is provided with a hoisting machine temperature sensor 8 for outputting a signal corresponding to a temperature of the hoisting machine 4. The inverter 5 is provided with an inverter temperature sensor 9 for outputting a signal corresponding to a temperature of the inverter 5. The inverter control circuit 6 is provided with a control circuit temperature sensor 10 for outputting a signal corresponding to a temperature of the inverter control circuit 6.

The opening/closing of a car door and a landing door is controlled by a door control circuit 11. The inverter control circuit 6 and the door control circuit 11 are controlled by an elevator operation control device 12.

The elevator operation control device 12 has a component temperature detecting portion 13, a component-protective operation control portion 14, and a operation supervising portion 15. The component temperature detecting portion 13 detects temperatures of the hoisting machine 4, the inverter 5, and the inverter control circuit 6 based on signals from the temperature sensors 8 to 10. The component-protective operation control portion 14 restrains the elevator from operating in accordance with the temperatures detected by the component temperature detecting portion 13. However, when all the detected temperatures are equal to or lower than their respective permissible values, the elevator is not restrained from operating. The operation supervising portion 15 supervises the operation of the elevator in accordance with information from the component-protective operation control portion 14. More specifically, the operation supervising portion 15 controls the inverter control circuit 6 and the door control circuit 11.

The elevator operation control device 12 is constituted by a computer having a calculation processing portion (CPU), a storage portion (ROM, RAM, hard disk, and the like), and signal input/output portions. The functions of the component temperature detecting portion 13, the component-protective operation control portion 14, and the operation supervising portion 15 are realized by the computer constituting the elevator operation control device 12. That is, control programs for realizing the functions of the component temperature detecting portion 13, the component-protective operation control portion 14, and the operation supervising portion 15 are stored in the storage portion of the computer. The calculation processing portion performs calculation processings regarding the functions of the component temperature detecting portion 13, the component-protective operation control portion 14, and the operation supervising portion 15 based on the control programs.

Next, an operation will be described. The temperatures of the hoisting machine 4, the inverter 5, and the inverter control circuit 6 rise if they are driven for a long time with loads applied to the car 1 and the counterweight 2 out of balance with each other, or if they are driven for a long time at a high acceleration/deceleration or a high speed. Thus, the temperatures of the hoisting machine 4, the inverter 5, and the inverter control circuit 6 are supervised by the elevator operation control device 12.

More specifically, the component temperature detecting portion 13 detects a temperature Tm of the hoisting machine 4, a temperature Ti of the inverter 5, and a temperature Tc of the inverter control circuit 6, and the detected results are transmitted to the component-protective operation control portion 14. The component-protective operation control portion 14 determines operation control parameters of the elevator based on the temperatures Tm, Ti, and Tc. A speed v of the car 1, an acceleration a of the car 1, a deceleration d of the car 1, a jerk (rate of change in acceleration) j of the car 1, a door-opening time (door-closing restraint time) tdo, a door-opening speed vdo, a door-closing speed vdc, and a possible number cn of cars to be allocated to calls in a group controlling system, and the like can be mentioned as the operation control parameters.

The door-opening time tdo represents a time it takes to make an automatic shift from a door-open state to a door-closed state without operating a door-closing button. The possible number cn of cars to be allocated to calls represents a restrictive condition in allocating a plurality of cars 1 to landing calls when the cars 1 are subjected to operation control as a group. For example, when the number of landing calls and car calls already registered in a certain one of the cars 1 is equal to or larger than cn, another landing call generated at that moment is allocated to another one of the cars 1.

Relationships between the aforementioned operation control parameters and the temperatures Tm, Ti, and Tc can be described as follows.

$v=fv(Tm, Ti, Tc)$
$a=fa(Tm, Ti, Tc)$
$d=fd(Tm, Ti, Tc)$
$j=fj(Tm, Ti, Tc)$
$tdo=ftdo(Tm, Ti, Tc)$
$vdo=fvdo(Tm, Ti, Tc)$
$vdc=fvdc(Tm, Ti, Tc)$
$cn=fcn(Tm, Ti, Tc)$ Each of all those functions fv, fa, fd, fj, ftdo, fvdo, fvdc, and fcn determines a value depending on the temperatures Tm, Ti, and Tc. The functions can be described according to a control rule as shown in, for example, FIG. 2.

Figure 2:
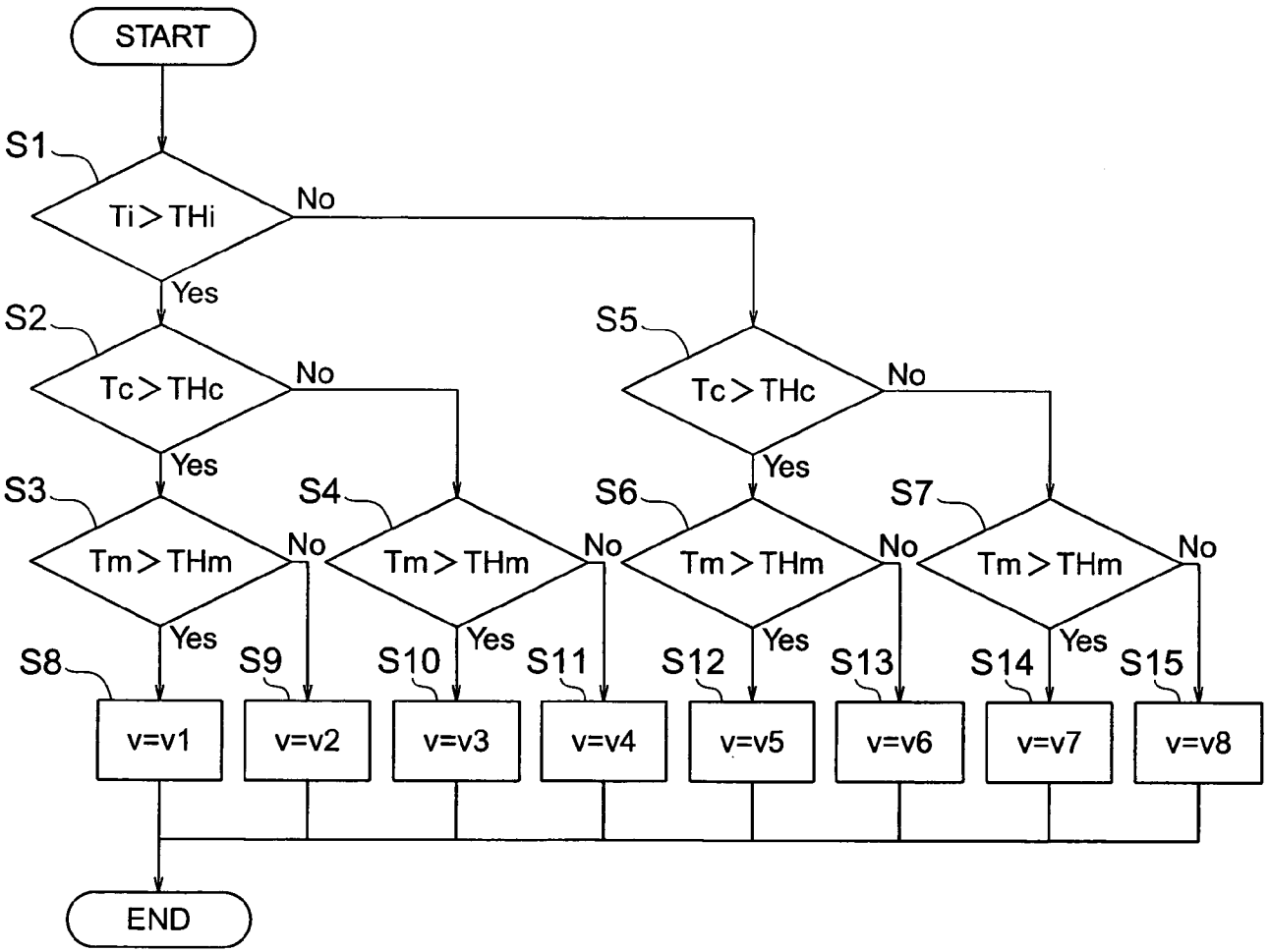
FIG. 2 is a flowchart showing an example of an operation of determining a speed in a component-protective operation control portion of FIG. 1.

FIG. 2 is a flowchart showing an example of an operation of determining a speed in the component-protective operation control portion 14 of FIG. 1. In the component-protective operation control portion 14, it is determined whether or not the temperature Ti has exceeded a permissible value THi of the temperature of the inverter 5 (Step S1), whether or not the temperature Tc has exceeded a permissible value THc of the temperature of the inverter control circuit 6 (Steps S2 and S5), and whether or not the temperature Tm has exceeded a permissible value THm of the temperature of the hoisting machine 4 (Steps S3, S4, S6, and S7).

The speed of the car 1 is selected from v1 to v8 in accordance with the determined results. That is, when Ti>THi, Tc>THc, and Tm>THm, the speed v1 is selected (Step S8). When Ti>THi, Tc>THc, and Tm<THm, the speed v2 is selected (Step S9). When Ti>THi, Tc<THc, and Tm>THm, the speed v3 is selected (Step S10). When Ti>THi, Tc<THc, and Tm<THm, the speed v4 is selected (Step S11).

Further, when Ti≦THi, Tc>THc, and Tm>THm, the speed v5 is selected (Step S12). When Ti≦THi, Tc>THc, and Tm≦THm, the speed v6 is selected (Step S13). When Ti≦THi, Tc≦THc, and Tm>THm, the speed v7 is selected (Step S14). When Ti≦THi, Tc≦THc, and Tm<THm, the speed v8 is selected (Step S15).

The speeds v1 to v8 can be set arbitrarily. The speeds v1 to v8 are not required to be completely different from one another.

Although only the speed v of the car 1 is illustrated in FIG. 2, the other operation control parameters can also be determined according to results of a comparison between Tm and THm, a comparison between Ti and THi, and a comparison between Tc and THc.

Figure 3:
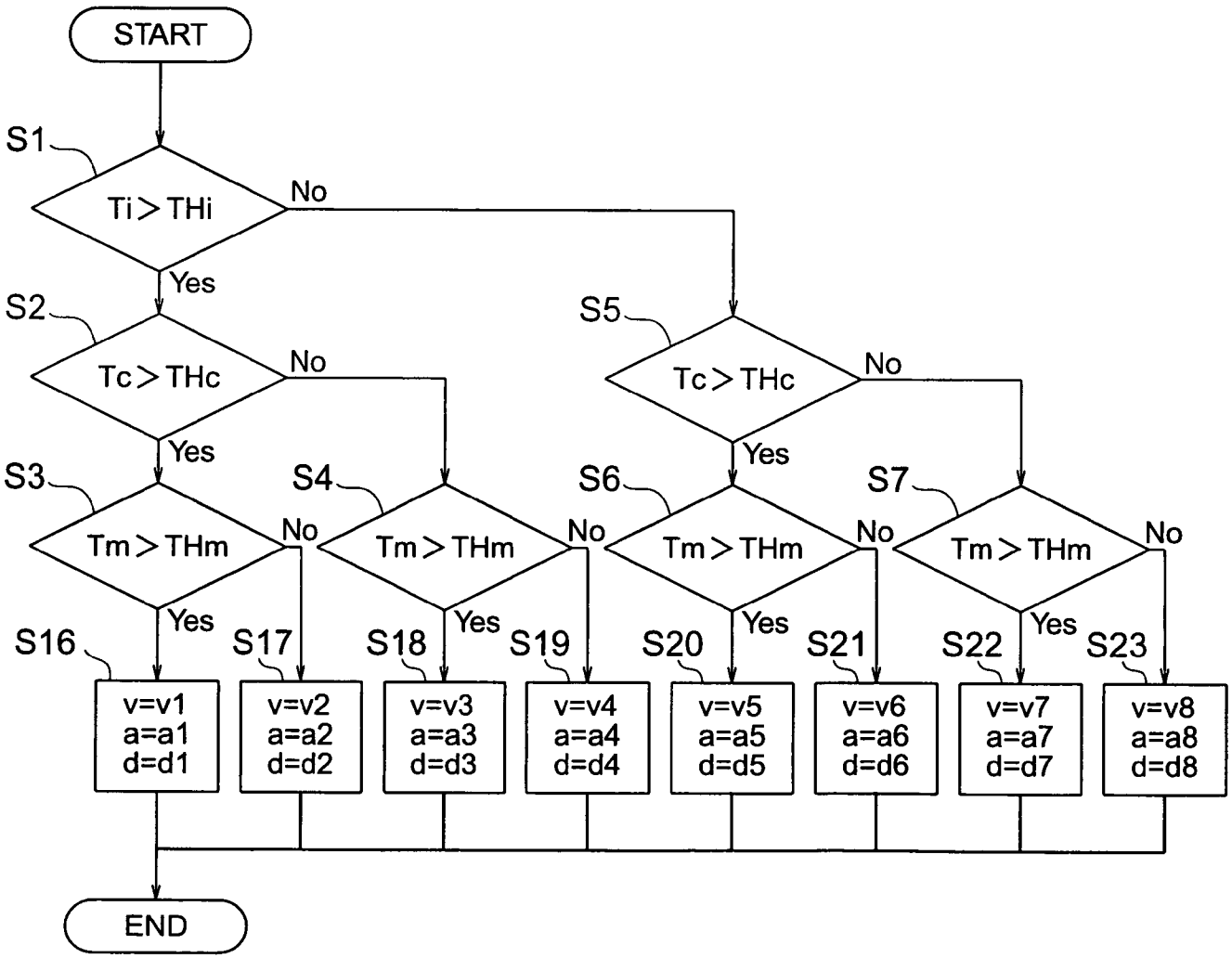
FIG. 3 is a flowchart showing an example of an operation of determining a speed, an acceleration, and a deceleration in the component-protective operation control portion of FIG. 1.

The values of the other operation control parameters may be determined individually. Alternatively, one of a plurality of parameter groups each formed of a combination of a plurality of parameters may be selected in accordance with results of the determinations made on the temperatures as shown in, for example, FIG. 3. In the example of FIG. 3, one of eight parameter groups is selected in accordance with results of the determinations made on the temperatures (Steps S16 to S23). Each of the parameter groups includes a speed, an acceleration, and a deceleration as parameters.

The values of the operation control parameters determined by the component-protective operation control portion 14 may be either the values of a speed and an acceleration themselves or coefficients used in subjecting a normal speed value and a normal acceleration value to calculation processings.

The operation control parameters determined by the component-protective operation control portion 14 are input to the operation supervising portion 15. The operation supervising portion 15 controls the inverter control circuit 6 and the door control circuit 11 based on the determined operation control parameters.

A concrete method of restraining the elevator from operating includes reduction of the speed v, reduction of the acceleration a, reduction of the deceleration d, reduction of the jerk j, prolongation of the door-opening time tdo, reduction of the door-opening speed vdo, reduction of the door-closing speed vdc, reduction of the possible number cn of cars to be allocated to calls, and the like.

In the case where the plurality of the cars 1 are supervised as a group, the values of the operation control parameters are determined for each of the cars 1.

In the elevator operation control device 12 configured as described above, the elevator is restrained from operating in accordance with the temperature of the drive device 7, so the temperatures of the components can be restrained from rising before the protection circuit operates. As a result, the elevator can be restrained from being stopped from operating due to rises in the temperatures of the components, so the operation efficiency of the elevator can be prevented from declining.

The door-opening time tdo is prolonged to retard the operation of the elevator and thus restrain the elevator from operating. Therefore, the elevator can be restrained from operating without changing the moving time of the car 1.

Further, the door-opening speed vdo and the door-closing speed vdc are reduced to retard the operation of the elevator and thereby restrain the elevator from operating. Therefore, the elevator can be restrained from operating without changing the moving time of the car 1.

Still further, the possible number cn of cars to be allocated to calls is reduced to retard the operation of elevators and thereby restrain the elevators from operating. Therefore, the elevators can be restrained from operating without changing the moving time of each of the cars 1.

Embodiment 2

Figure 4:
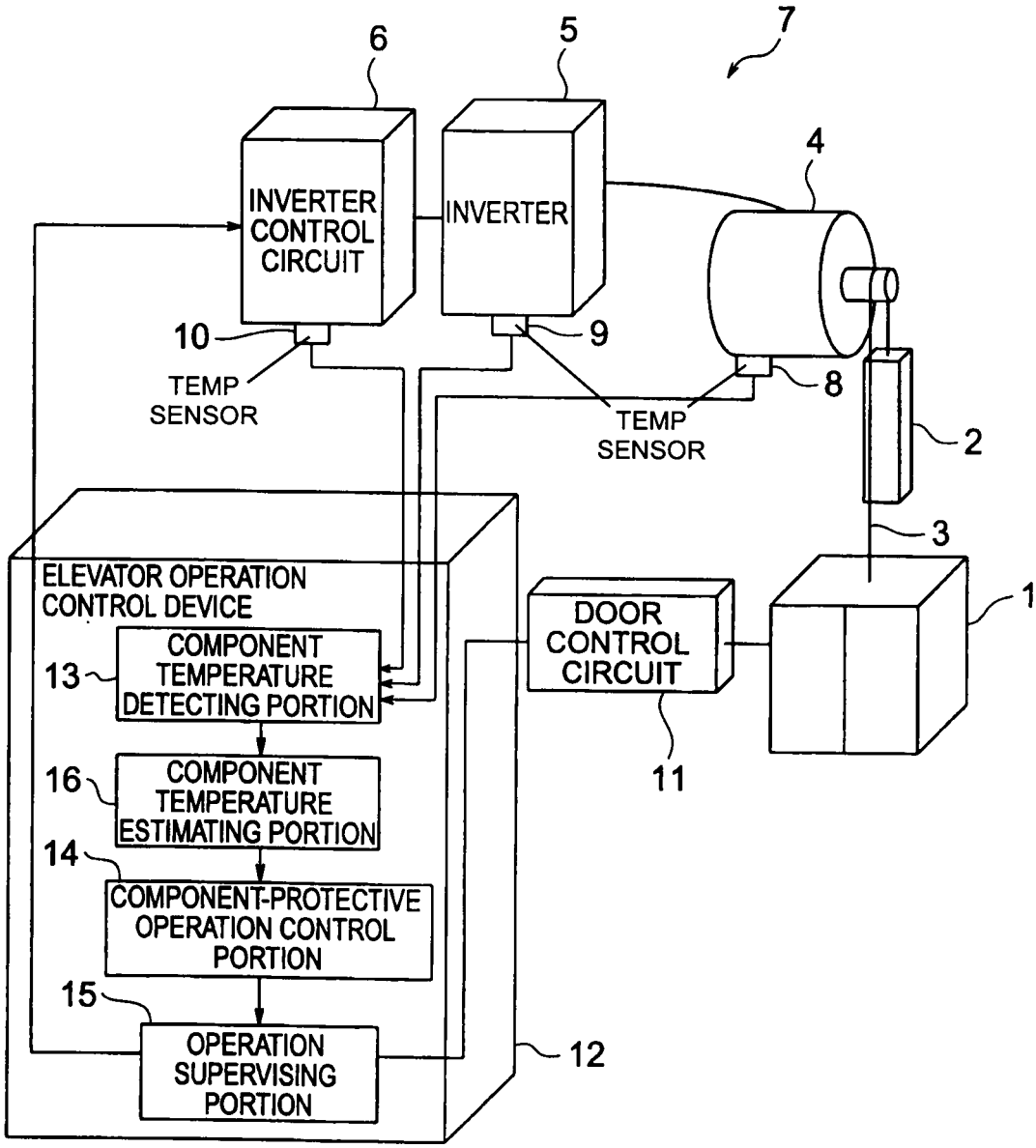
FIG. 4 is a schematic diagram showing an elevator apparatus according to Embodiment 2 of the present invention.

Reference is made next to FIG. 4. FIG. 4 is a schematic diagram showing an elevator apparatus according to Embodiment 2 of the present invention. Referring to the figure, the elevator operation control device 12 has the component temperature detecting portion 13, a component temperature estimating portion 16, the component-protective operation control portion 14, and the operation supervising portion 15. The component temperature estimating portion 16 predicts future temperatures of the hoisting machine 4, the inverter 5, and the inverter control circuit 6 based on signals from the component temperature detecting portion 13. The component-protective operation control portion 14 restrains the elevator from operating in accordance with the temperatures predicted by the component temperature estimating portion 16.

The function of the component temperature estimating portion 16 is realized by the computer constituting the elevator operation control device 12. That is, a control program for realizing the function of the component temperature estimating portion 16 is stored in the storage portion of the computer. The calculation processing portion performs a calculation processing regarding the function of the component temperature estimating portion 16 based on the control program. Embodiment 2 of the present invention is identical to Embodiment 1 of the present invention in other configurational details.

The function of the component temperature estimating portion 16 will now be described in more detail. The component temperature estimating portion 16 periodically acquires the values of Tm, Ti, and Tc from the component temperature detecting portion 13, saves those values as a time-series pattern, and estimates a tendency of future changes in the temperatures based on the time-series pattern. For example, when Tm(t), Ti(t), and Tc(t) are input at a time point t, the component temperature estimating portion 16 stores them into a memory. The component temperature estimating portion 16 then estimates temperatures Tm(t+1), Ti(t+1), and Tc(t+1) at a time point t+1 from N past values stored in the memory, namely, Tm(t), Ti (t), Tc(t), . . . Tm(t−N+1), Ti(t−N+1), and Tc(t−N+1).

Various methods can be applied in order to estimate the temperatures. For example, a least-squares method may be adopted. The component-protective operation control portion 14 determines the operation control parameters as in the case of FIG. 2 or 3, based on the temperatures Tm(t+1), Ti (t+1), and Tc(t+1) calculated by the component temperature estimating portion 16.

The component temperature estimating portion 16 may output characteristics of the time-series pattern as a tendency of changes in temperatures instead of estimating future temperatures themselves. For example, the component temperature estimating portion 16 may compare a stored temperature Tm(τ) at an arbitrary time point τ with a stored temperature Tm(τ−1), and calculate a number of times of establishment of a relationship: Tm(τ)>Tm(τ−1), namely, a number jm of times of rise in temperature as to the temperatures from Tm(t−N+1) to Tm(t).

In this case, the temperature Tm(t) of the hoisting machine 4 at the time point t and the number jm of times of rise in temperature are output from the component temperature estimating portion 16. The component-protective operation control portion 14 then determines the operation control parameters based on the temperature Tm(t) and the number jm of times of rise in temperature.

Figure 5:
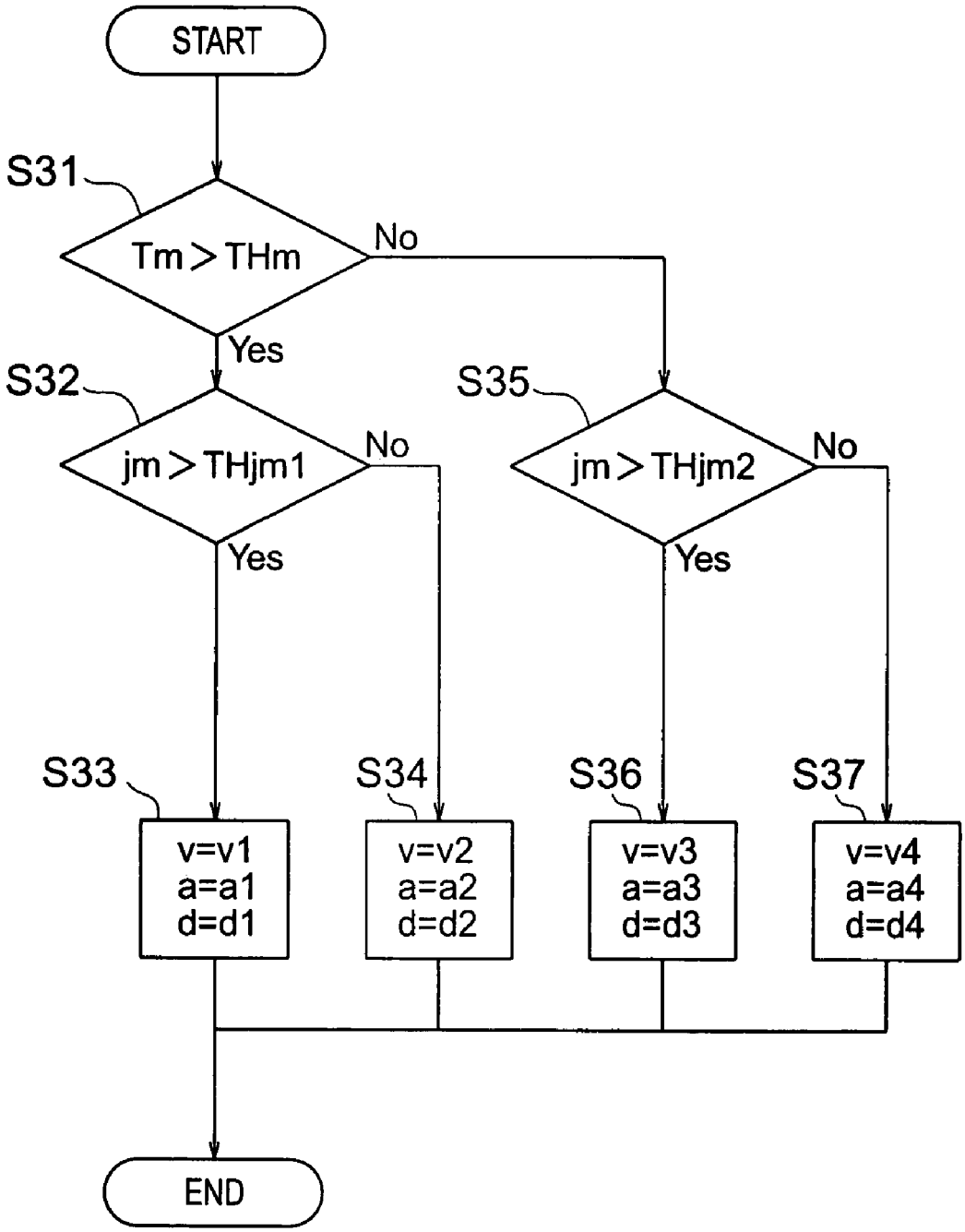
FIG. 5 is a flowchart showing an example of an operation of determining a speed, an acceleration, and a deceleration in a component-protective operation control portion of FIG. 4.

FIG. 5 is a flowchart showing an example of an operation of determining a speed, an acceleration, and a deceleration in the component-protective operation control portion 14 of FIG. 4. For the sake of simplicity, FIG. 5 illustrates a case where only the temperature Tm of the hoisting machine 4 is detected. In the component-protective operation control portion 14, it is determined whether or not the current temperature Tm has exceeded the permissible value THm (Step S31). When Tm>THm, it is determined whether or not the number jm of times of rise in temperature has exceeded a first threshold THjm1 (Step S32). When jm>THjm1, v1, a1, and d1 are selected (Step S33). When jm<THjm1, v2, a2, and d2 are selected (Step S34).

When Tm≦THm, it is determined whether or not the number jm of times of rise in temperature has exceeded a second threshold THjm2 (Step S35). When jm>THjm2, v3, a3, and d3 are selected (Step S36). When jm≦THjm2, v4, a4, and d4 are selected (Step S37).

In the elevator operation control device 12 configured as described above, the elevator is restrained from operating based on a tendency of changes in the temperature of the drive device 7, so rises in the temperatures of the components can be suppressed more reliably before the protection circuit operates. Thus, the elevator can be restrained from being stopped from operating due to rises in the temperatures of the components, so the operation efficiency of the elevator can be prevented from declining.

In the foregoing examples, the temperature Tm of the hoisting machine 4, the temperature Ti of the inverter 5, and the temperature Tc of the inverter control circuit 6 are detected as the temperature of the drive device 7. However, only a part of these temperatures may be detected. Further, either a temperature of a motor or a temperature of a drive sheave may be detected as the temperature of the hoisting machine 4. Furthermore, a temperature of a main rope may be detected as the temperature of the drive device 7. In a case where a resinous main rope is used, the main rope can be prevented from being damaged by heat in advance. Still further, a temperature of a bearing for receiving a shaft of a rotary body such as the drive sheave may also be detected.

In the foregoing examples, the speed v, the acceleration a, the deceleration d, the jerk j, the door-opening time tdo, the door-opening speed vdo, the door-closing speed vdc, and the possible number cn of cars to be allocated to calls are mentioned as the operation control parameters for restraining the elevator from operating. However, only a part of those parameters may be subjected to restraint control. Other operation control parameters may also be subjected to restraint control as long as the elevator can be restrained from operating.

Moreover, in the foregoing examples, the functions of the component-protective operation control portion 14 and the operation supervising portion 15 are performed by the single computer. However, those functions may also be performed by separate computers.

Still further, the means for realizing the function of the component-protective operation control portion 14 is not limited to the computer. For example, an analog signal processing circuit may be used to realize the function of the component-protective operation control portion.

Further, in the foregoing examples, the elevator apparatus structured such that the car 1 is raised/lowered by the single hoisting machine 4 is illustrated. However, the present invention is also applicable to an elevator apparatus structured such that a single car is raised/lowered by a plurality of hoisting machines.

In addition, the present invention is also applicable to an elevator apparatus of such a type that the speed of a car during constant-speed running thereof and the acceleration/deceleration of the car are changed in accordance with a load within the car.

The invention claimed is:

1. An elevator operation control device, comprising:

a component temperature detecting portion for detecting a temperature of a drive device; and a component-protective operation control portion for restraining an elevator from operating in accordance with the temperature detected by the component temperature detecting portion, wherein the component-protective operation control portion prolongs a time from a door-open state to a door-closed state to retard operation of the elevator in restraining the elevator from operating.

2. An elevator operation control device, comprising:

a component temperature detecting portion for detecting a temperature of a drive device; and a component protective operation control portion for restraining an elevator from operating in accordance with the temperature detected by the component temperature detecting portion, wherein the component-protective operation control portion changes an allocation of calls to retard operation of the elevator in restraining the elevator from operating.

3. An elevator operation control device, comprising:

a component temperature detecting portion for detecting a temperature of a drive device;

a component-protective operation control portion for restraining an elevator from operating in accordance with the temperature detected by the component temperature detecting portion; and a component temperature estimation portion for calculation a tendency of changes in the temperature of the drive device based on information from the component temperature detecting portion, wherein the component-protective operation control portion for restrains the elevator from operating in accordance with information from the component temperature estimating portion.

4. An elevator system, comprising:

an elevator car;

an elevator vertical movement control system including at least a drive device which raises and lowers the elevator car including at least a motor, and a controller which controls an operation of the motor which raises and lowers the elevator car;

a control system which detects a temperature of the drive device and reduces an amount of a vertical movement of the elevator car to prevent an overheating condition while allowing the elevator car to continue to be raised and lowered to a plurality of floors.

5. An elevator system according to claim 4, wherein:

the control system reduces an amount of vertical movement by prolonging a time from a door-open state to a door-closed state.

6. An elevator system according to claim 4, wherein:

the control system reduces an amount of vertical movement by reducing at least one of a door-opening speed and a door-closing speed.

7. An elevator system according to claim 4, wherein:

the control system reduces an amount of vertical movement by changing an allocation of calls.

8. An elevator system according to claim 4, wherein:

the control system reduces an amount of vertical movement by reducing at least one of a speed of the elevator car, an acceleration rate of the elevator car, a deceleration rate of the elevator car, and a change in the acceleration rate of the elevator car.

9. An elevator system according to claim 4, wherein:

the control system stops movement of the elevator car when the temperature which has been detected reaches an overheating condition.

10. An elevator system according to claim 4, wherein:

the control system detects temperature of an inverter control circuit.

11. An elevator system according to claim 4, wherein:

the control system detects temperature of an inverter.

12. An elevator system according to claim 4, wherein:

the control system detects temperature of a motor.

13. An elevator system according to claim 4, wherein:

the control system detects temperature of a drive sheave.

14. An elevator system according to claim 4, wherein:

the control system detects temperature of a rope.

15. An elevator system according to claim 4, wherein:

the controller which controls the operation of the motor and the control system which detects the temperature and reduces the amount of vertical movement is the same controller.

* * * * *